US007491912B1

(12) United States Patent
Check

(10) Patent No.: US 7,491,912 B1
(45) Date of Patent: Feb. 17, 2009

(54) PORTABLE CONTAINER WITH TEMPERATURE CONTROL CHAMBER

(75) Inventor: Robert Check, Clarkston, MI (US)

(73) Assignee: Check Corporation, Troy, MI (US)

( * ) Notice: Subject to any disclaimer, the term of this patent is extended or adjusted under 35 U.S.C. 154(b) by 161 days.

(21) Appl. No.: 11/460,405

(22) Filed: Jul. 27, 2006

(51) Int. Cl.
*F24C 7/10* (2006.01)
*B65D 33/16* (2006.01)

(52) U.S. Cl. ..... 219/386; 219/385; 219/387; 219/528; 219/529; 219/530; 219/523; 219/544; 219/549; 383/84; 383/86; 383/97; 383/99; 206/545; 206/459.1; 206/495.5; 99/483

(58) Field of Classification Search ..... 219/385–7, 219/523, 528–30, 540, 544, 549, 521; 383/84, 383/86, 97–9, 110, 14, 101; 206/545, 459.1, 206/495.5; 99/483; 374/141, 149–50
See application file for complete search history.

(56) References Cited

U.S. PATENT DOCUMENTS 5,892,202 A * 4/1999 Baldwin et al. ..... 219/387
6,281,477 B1 8/2001 Forrester et al.

* cited by examiner

*Primary Examiner*—Shawntina Fuqua
(74) *Attorney, Agent, or Firm*—Reising, Ethington, Barnes, Kisselle, P.C.

(57) ABSTRACT

A portable food delivery container includes a food storage compartment, a control compartment, and a temperature control source. A control compartment lies adjacent to and in thermal conductivity with the food storage compartment. A modular removable temperature control source is disposed within the control compartment, where the temperature control source effects transfer of thermal energy between the food storage compartment and the control compartment to maintain the food storage compartment at a temperature other than the ambient temperature.

22 Claims, 4 Drawing Sheets

PORTABLE CONTAINER WITH TEMPERATURE CONTROL CHAMBER

FIELD OF THE INVENTION

This invention relates generally to a portable container and, more particularly, to a portable container having a temperature controlled compartment.

BACKGROUND OF THE INVENTION

Food delivery containers, such as hot bags for pizza, are commonly used to keep food from getting cold during transportation. Typically, these containers are lightweight, durable, portable, and generally use insulation, a temperature control source, or both in combination.

Hot bags have developed over time from simple insulated containers to actively heated containers. An insulated container simply minimizes heat loss. A heated container uses a heat source to add heat to a food item, instead of simply retarding heat loss. Heated containers may keep food items warmer for a longer time period so that a delivery person may have more time to deliver the food and a warmer product may be provided to the consumer. Heated containers can also be used for in-store heated storage of food items.

In many heated containers, the heat source is placed with the food item inside the food storage compartment. Since these containers are used frequently, the constant loading and unloading of food items call cause damage to the bag and the heat source itself. Pizza boxes, for example, can easily snag or impact a heat source, causing damage to the heat source, the pizza box, or both. Direct contact also creates a heat distribution issue. With many configurations, the heat source will provide uneven heat, causing hot and cold spots.

SUMMARY OF THE INVENTION

An insulated portable food delivery container may comprise a food storage compartment having an outer surface and an opening through which an item can be moved into and out of the food storage compartment. The container may also have an entry flap that can be moved from an open position to a closed position wherein the entry flap substantially covers the opening, a control compartment lying adjacent to and in contact with the outer surface of the flood storage compartment, and a removable temperature control source disposed within the control compartment.

In one implementation, the temperature control source is a heat source that converts electrical energy into heat that is communicated with the food storage compartment. The control compartment in which the heat source is received preferably is isolated from the food storage compartment so that no part of the heat source is exposed to the food storage compartment. Further, the heat source may be releasably received in the control compartment so that it may be removed if it or the bag needs to be serviced, cleaned or replaced, for example. The heat source may include an at least somewhat rigid frame that may facilitate insertion of the heat source into the control compartment, and may also prevent folding or undue bending of the heat source during installation and in use.

BRIEF DESCRIPTION OF THE DRAWINGS

The following detailed description of presently preferred embodiments and best mode will be made with reference to the accompanying drawings, in which.

DETAILED DESCRIPTION OF PREFERRED EMBODIMENTS

Referring in more detail to the drawings, FIGS. 1-5 show a portable food delivery container 10 that includes a food storage compartment 20 and upper and lower control compartments 50, 52. The portable food delivery container 10 may be used, for example, to keep food items within a desired temperature range during storage and/or delivery. The food items are typically prepared at a restaurant, such as a delivery/carry-out pizza shop, placed within food storage compartment 20, and then delivered to a customer. The temperature of the stored food items can then be maintained within a desired temperature range inside food storage compartment 20.

Depending on the application in which the container is used, the food storage compartment may be maintained warmer or cooler than the ambient temperature. For instance, a pizza, hot sandwich or other hot food or beverage item may be kept at a temperature well above ambient so it will be relatively warm or hot when delivered. Other food items, such as cold sandwiches, salads, soft drinks, or other food or beverage item may be kept below room temperature, so they remain relatively cool while delivered. Of course, it will be recognized by one skilled in the art that portable rood delivery container 10 can also be used for non-food items. For example, there are many non-food items that should be stored and transported at a temperature other than room temperature. Medical items like blankets for hypothermia victims may be transported and kept above room temperature, while other medical items like certain medicines may need to be transported and kept below room temperature.

Figure 1:
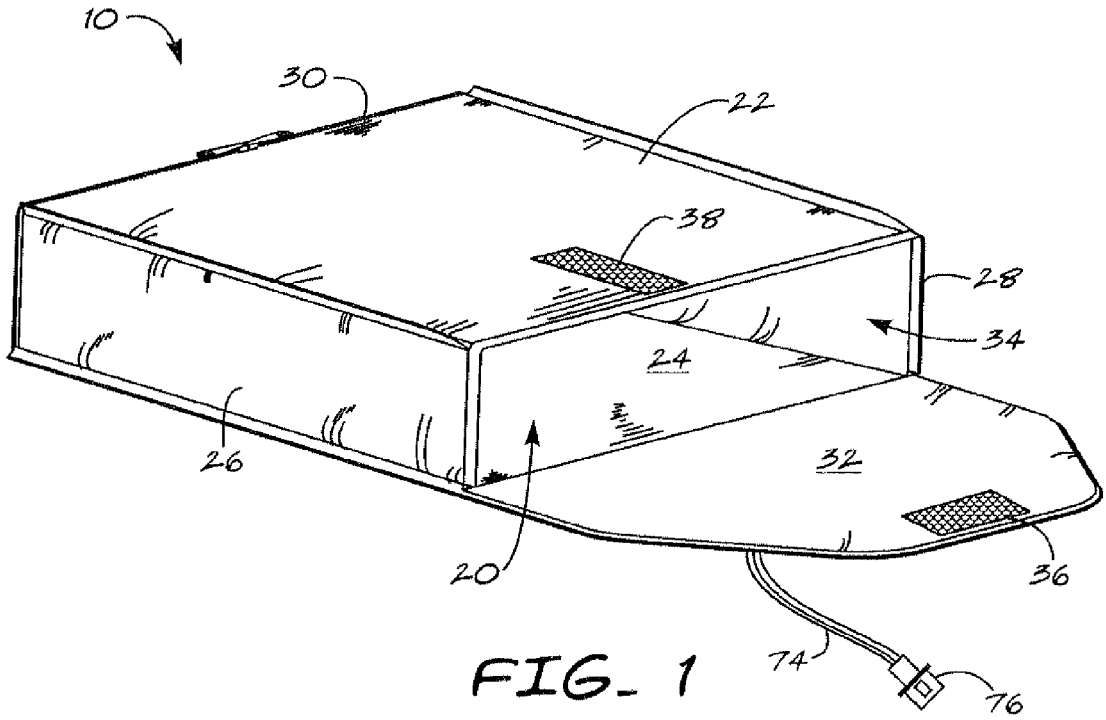
FIG. 1 is a front perspective view of a portable food delivery container showing an entry flap in its open position.
Figure 2:
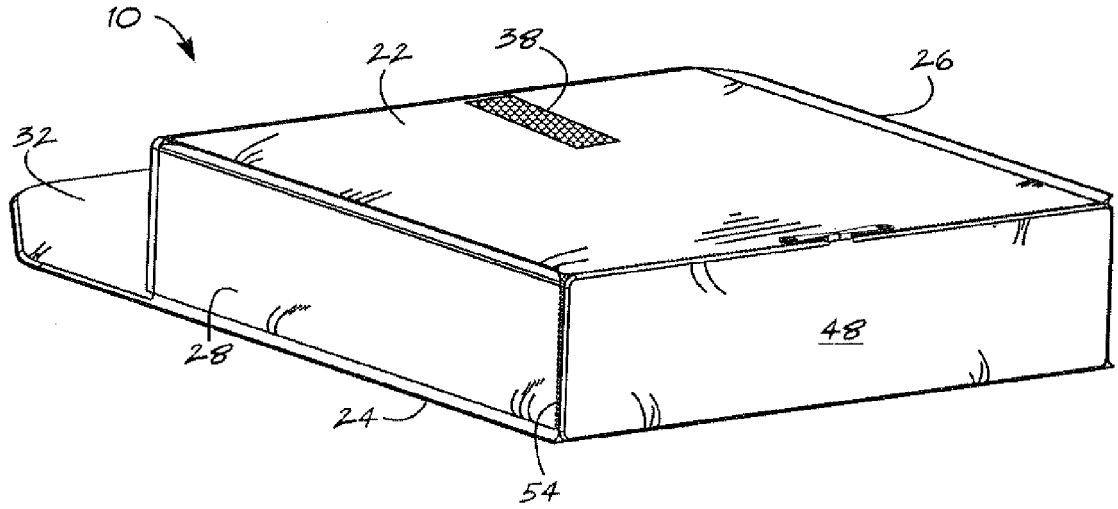
FIG. 2 is a rear perspective view of a portable food delivery container showing an access panel in its closed position.

In one embodiment, food storage compartment 20 includes a parallelepiped enclosure bounded by five rectangular walls and a front closure, such as an entry flap or wall that is moveable. More specifically, food storage compartment 20, as shown in FIGS. 1-4, may be bounded by the interior surfaces of interconnected upper and lower walls 22, 24; side walls 26, 28; rear wall 30; and entry flap 32. Food storage compartment 20 may be accessed through opening 34 that is formed when entry flap 32 is placed in the open position, as shown in FIG. 1.

The size and shape of food storage compartment 20 may vary, and may correspond to the particular application. For example, food storage compartment 20 can be sized to hold two 18-inch pizzas or roughly having dimensions of 6-inches tall by 20 inches wide by 20 inches long. If the intended use is for differently sized or different quantities of food items, then food storage compartment 20 can be sized accordingly. Food storage compartment 20 may take other forms besides a parallelepiped, such as a spheroid, ellipsoid, or other form.

The form may be chosen based on the particular application, such as to conform to the shape of the stored item.

Food storage compartment 20 may be constructed in a number of ways. For example, upper, lower, side, and rear walls 22-30, and entry flap 32 may be individual pieces of material that form food storage compartment 20 by connecting the walls and flap together along adjacent edges. Multiple walls, including entry flap 32, may also be formed from one piece of material, bending or folding the material to from two or more walls. For example, upper, lower, and side walls 22-28 may be formed by folding one rectangular piece of flexible material and connecting it to itself. Lower wall 24 and entry flap 32 may also be formed from one rectangular piece of material. The various pieces of material may be continuously connected, which may facilitate completely enclosing the food storage compartment 20. One skilled in the art will recognize that many other configurations are also possible.

Walls 22-30 and entry flap 32 may be made of a flexible and durable material, such as nylon. Nylon is also suitable for efficiently facilitating thermal energy transfer between food storage compartment 20 and control compartments 50, 52. Furthermore, nylon is also useful for allowing moisture to permeate through food storage compartment 20. This may be desirable when transporting certain items, such as a hot pizza, to limit or prevent condensation in food storage compartment 20. Walls 22-30 and entry flap 32 may also include insulation to minimize undesirable thermal energy transfer between food storage compartment 20 and the environment. Such insulation may be used within those walls that have exterior surfaces that are exposed to the environment. One suitable insulation material is called Thermoloft and is man manufactured by Dupont.

Generally, the interior surfaces of walls 22-30 and entry flap 32 that form food storage compartment 20 may be smooth and devoid of any obstructions, pockets, or other internal features. This construction may serve multiple functions. For example, portable food delivery container 10 may be used for food delivery, which typically means that food items may be inserted into and removed from food storage compartment 20 many times when entry flap 32 is in the open position, as shown in FIG. 1. A smooth interior construction may ensure that food items and portable food delivery container 10 are not damaged during use, specifically while food items are moving through opening 34. Also, a smooth interior construction may facilitate cleaning food storage compartment 20, since food item remnants are not trapped in internal pockets or crevices and can be easily removed. Connecting walls 22-30 and entry flap 32 in a continuous fashion may also facilitate cleaning food storage compartment 20. Furthermore, the walls may be continuously connected so that storage compartment 20 is a complete enclosure, leaving only opening 34 for food items to pass through when entry flap 32 is in the open position.

Entry flap 32 moves between open and closed positions to selectively permit access to food storage compartment 20. When entry flap 32 is in the open position, as shown in FIG. 1, food items can pass through opening 34. When placed in the closed position, entry flap 32 substantially covers opening 34, securely holding food items in place, and substantially completing the enclosure of food storage compartment 20. Entry flap 32 may be made of flexible material and may be pivotally connected to lower wall 24. In one embodiment, lower wall 24 and entry flap 32 may be made from one continuous piece of material, where entry flap 32 is merely an extension of sufficient size to substantially cover opening 34.

When placed in the closed position, entry flap 32 may be secured to the exterior surface of upper wall 22 by a variety of means. For example, complementary fasteners 36, 38 may be disposed on entry flap 32 and upper wall 38 respectively. Complementary fasteners 36, 38 may be any suitable fastener such as, without limitation, a typical hook-and-loop fastener, a zipper, snap, or a button or buttons. Generally, complementary fasteners 36, 38 allow a user to quickly and easily move entry flap 32 between open and closed positions, but secure entry flap 32 to upper wall 22 when placed in the closed position.

Figure 3:
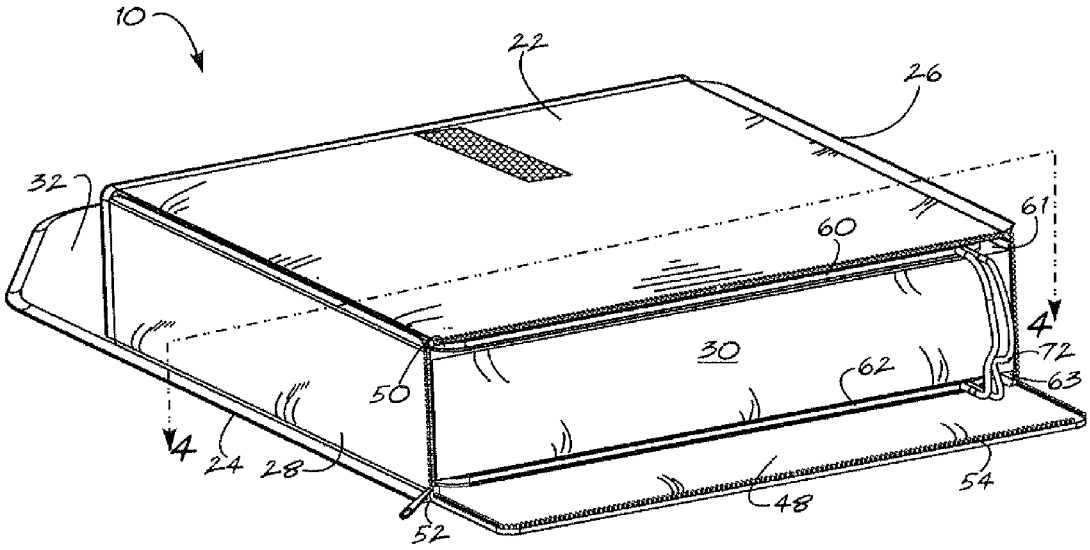
FIG. 3 is a rear perspective view of a portable food delivery container showing the access panel in its open position.
Figure 4:
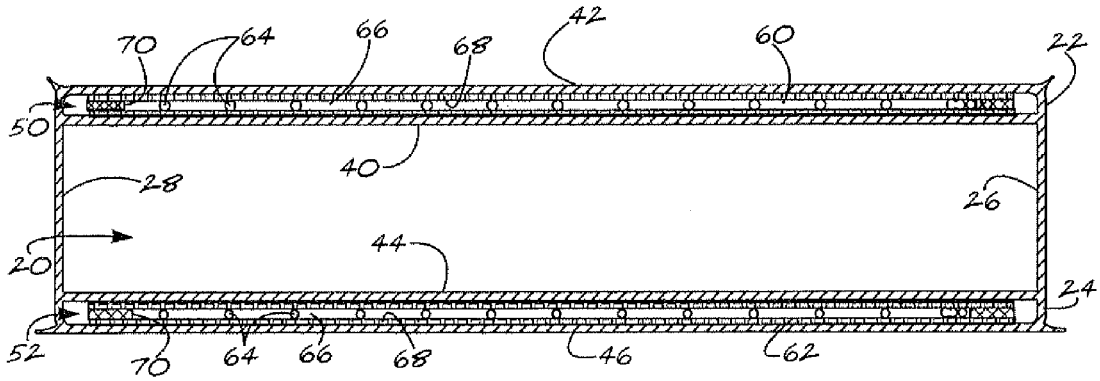
FIG. 4 is a cross-sectional view taken along line 4-4 of FIG. 3 showing heating elements inside the upper and lower control compartments.
Figure 5:
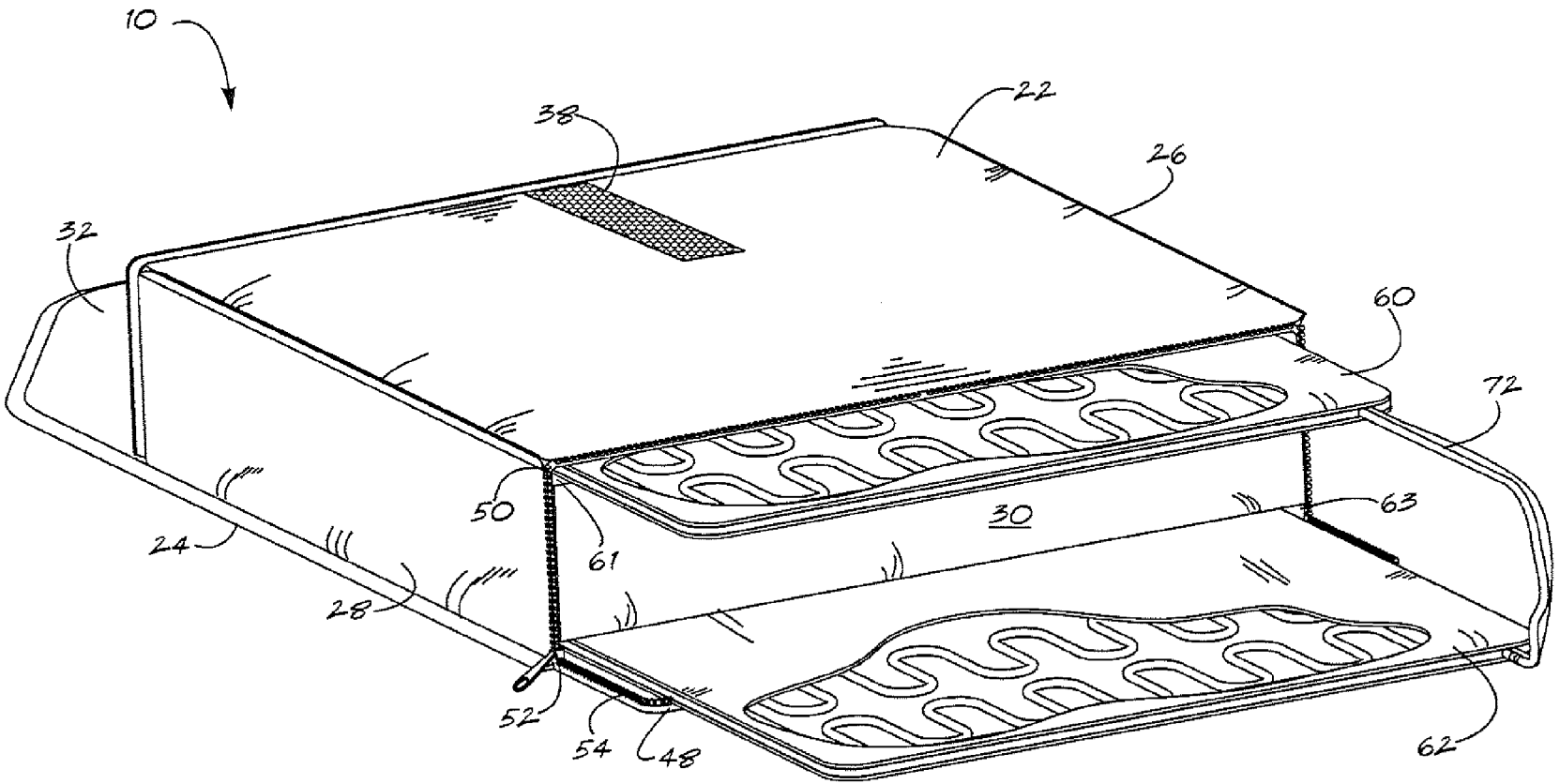
FIG. 5 is a rear perspective view of a portable food delivery container showing the access panel in its open position and the heating elements in a partially inserted state.

In one presently preferred embodiment, upper and lower control compartments 50, 52 lie adjacent to food storage compartment 20. As shown in FIGS. 3-5, upper and lower walls 22, 24 may include upper and lower control compartments 50, 52, respectively. As shown, each control compartment may be positioned adjacent to food storage compartment 20. To keep stored items within a desired temperature range, thermal energy may be transferred between food storage compartment 20 and control compartments 50, 52.

Figure 6:
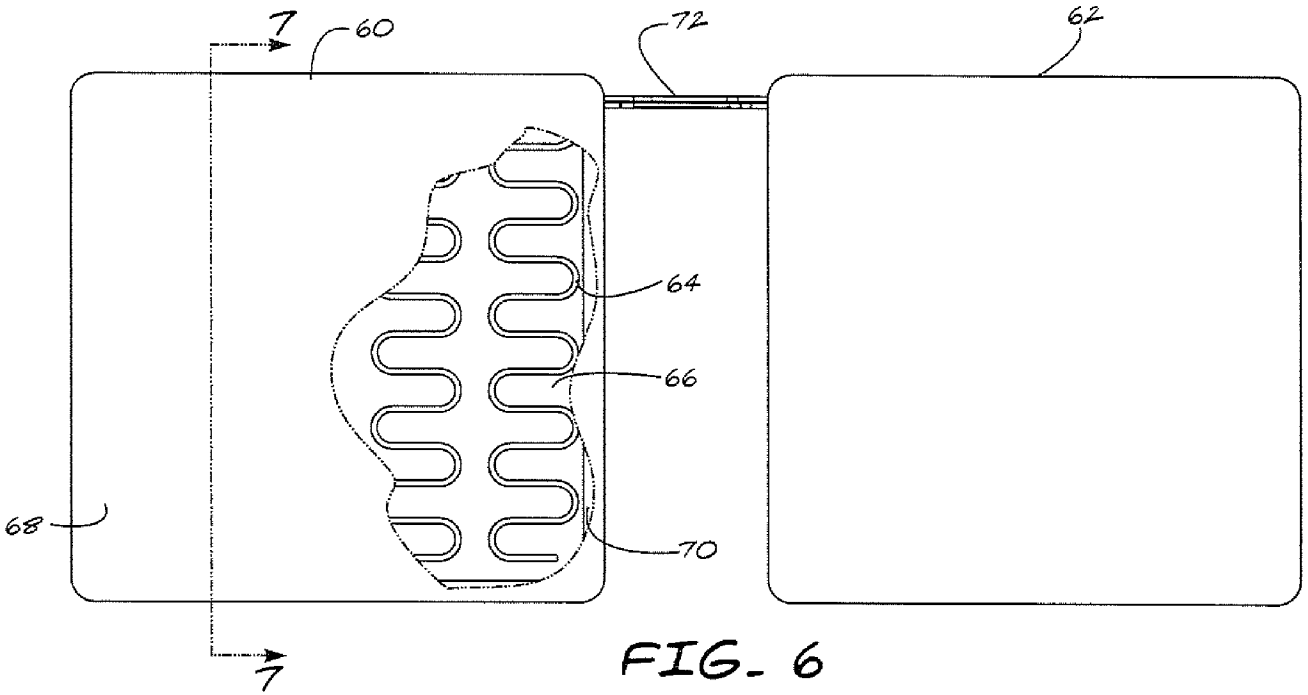
FIG. 6 is a plan view of the heating elements with a partial cut-away showing the conductor.
Figure 7:
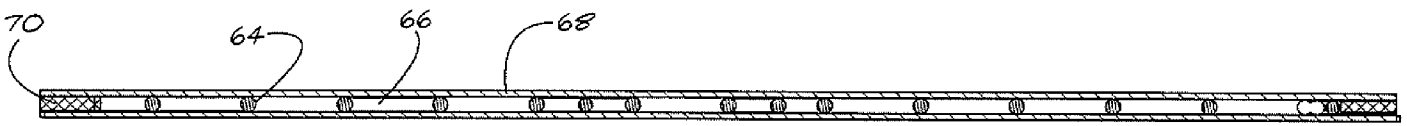
FIG. 7 is a cross-sectional view taken along line 7-7 of FIG. 6 showing a portion of the heating element.

Control compartments 50, 52 facilitate such desirable thermal energy transfer by housing temperature control sources 60, 62. Generally, a temperature control source, as shown in FIGS. 5-7, either adds heat to or removes heat from food storage compartment 20. When transporting a hot item such as a pizza, the temperature control source may be a heat source, such as an electric heating element. And when transporting cold items like salads and soft drinks, the temperature control source may be a heat absorber, like an ice pack or refrigeration coils. So upper and lower temperature control sources 60, 62 may be housed within upper and lower control compartments 50, 52, respectively, to facilitate desirable thermal energy transfer.

A control compartment facilitates such thermal energy transfer by, for example, providing a path of least resistance for such energy transfer. In one embodiment, control compartments 50, 52 each have a thin boundary that separates them from food storage compartment 20, and an insulated boundary that separates them from the environment. The thin boundary allows thermal energy to transfer efficiently between the compartments, while the insulated boundary prevents or limits thermal energy to transfer with the environment.

Control compartments 50, 52 may be permanently affixed to and separate from food storage compartment 20. In one embodiment shown in FIG. 4, control compartments 50, 52 lie within upper and lower walls 22, 24 respectively. Upper wall 22, for example, includes upper control compartment 50 bounded between interior wall or surface 40 and exterior wall or surface 42. And lower wall 24 includes lower control compartment 52 bounded between interior wall or surface 44 and exterior wall or surface 46. While food storage compartment 20 and control compartments 50, 52 may share a boundary, they preferably are completely separate enclosures that are adjacent to but isolated from one another. In such an embodiment, interior surfaces 40, 44 may be thin boundaries that facilitate efficient thermal energy transfer, and exterior surfaces 42, 46 may be insulated boundaries that prevent or limit undesirable thermal energy transfer with the environment.

In one embodiment, interior surfaces 40, 44 may be thin flexible material like nylon. Such thin material allows the compartments to remain isolated while facilitating efficient thermal energy transfer. Exterior surfaces 42, 46 are in contact with the environment and may include insulation to minimize undesirable thermal energy transfer. Insulation may also be used within side walls 26, 28 to further limit undesirable thermal energy transfer between food storage compartment 20 and the environment. Exterior fabric surfaces may be formed with a higher, heavier and/or thicker denier nylon (for example, without limitation, 1000 denier) which may reduce and/or inhibit heat transfer to the exterior or ambient. Interior fabric surfaces may be formed of lower, thinner and/or smaller denier nylon (for example, without limitation, 600 denier) to more readily permit heat transfer between the storage and control compartments. The density of the weave of the interior and exterior surfaces may be about the same, although different weave densities may be used if desired.

In one embodiment is shown in FIGS. 3-5, control compartments 50, 52 may have length and width dimensions closely matching those of food storage compartment 20. In such an embodiment, control compartments 50, 52 may be coextensive with upper aid lower walls 22, 24. And control compartments 50, 52 may be configured such that their respective edges are generally aligned with those of food storage compartment 20, as shown in FIG. 4. Portable food delivery container 10 may then appear more uniform and facilitate a more even distribution of thermal energy transfer between control compartments 50, 52 and food storage compartment 20.

Control compartments 50, 52 may be sized to accommodate desired temperature control sources 60, 62. For example, electric heating elements may be substantially smaller in overall height than ice packs or refrigeration coils. The height of control compartments 50, 52 may be substantially small, even less than ¼ inch, to accommodate thin temperature control sources, such as thin electric heating elements. But the height of control compartments 50, 52 can be large enough to accommodate various other types of temperature control sources or even multiple temperature control sources inside of one control compartment.

Control compartments 50, 52 may be substantially complete enclosures with an opening for insertion and removal of upper and lower temperature control sources 60, 62. As shown in FIGS. 3 and 5, the openings 61, 63 providing access to control compartments 60, 62 may be disposed adjacent the rear of the bag and permit installation of the heat sources in a direction opposite the direction in which items are placed into the storage compartment through the opening 34. By facing the openings 61, 63 away from opening 34, interference between temperature control sources 60, 62 and food items can be prevented or minimized. Furthermore, a user in a hurry will not confuse the openings 61, 63 or mistakenly insert a food item in the control compartment. Also, a user can replace either temperature control source 60 or 62 regardless of whether food items are currently being stored.

Access panel 48 may be pivoted and connected to one of the container walls, such as the bottom wall, and may be moved between open and closed positions to selectively permit access to control compartments 50, 52. The control compartments 50, 52 may be communicated with each other between the rear wall 30 and the access panel 48 to facilitate interconnecting control sources 60, 62 together, if desired. When access panel 48 is in the open position, as shown in FIG. 5, temperature control sources 60, 62 can be inserted into upper and lower control compartments 50, 52 respectively. When placed in the closed position, access panel 48 substantially covers the openings 61, 63, securely holding temperature control Sources 60, 62 in place, and substantially completing the enclosure of control compartments 50, 52. One side of access panel 48 may be carried by or formed in one-piece with a wall of portable food delivery container 10, and one or more of the other sides may be releasably connected to the container by a fastener 54, which is a zipper in the implementation shown. When placed in the closed position, access panel 48 secures temperature control sources 60, 62 in place, preventing them from becoming accidentally dislodged. In one embodiment, access panel is an insulated flexible material that substantially covers rear wall 30 when placed in the closed position.

Control compartments 50, 52 may also use fasteners near their respective openings, in conjunction with access panel 48. In one embodiment, a typical hook-and-loop fastener is used on the interior surfaces of control compartments 50, 52 near their respective openings 61, 63. This fastener ensures that temperature control sources 60, 62 remain within control compartments 50, 52 even when access panel 48 is in the open position. Other types of fasteners may also be used to secure temperature control sources 60, 62 within control compartments 50, 52. Fasteners, like typical hook-and-loop type fasteners, can be moved from the open position to the closed position quickly and easily, but still provide adequate support to hold a temperature control source in place.

Temperature control sources 60, 62 may be removable, modular, electric heating elements, as shown in FIGS. 6 & 7. Temperature control sources 60, 62 include conductor 64, carrier 66, shell 68, frame 70, electric link 72, and power cord 74. Heat is produced by supplying an electric current through conductor 64, which has suitable resistance to provide the desired amount of heat when such an electric current is applied. Conductor 64 is generally in the form of a resistance wire located within carrier 66, which is typically a layer of flexible material in the form of a planar or flat sheet. The resistance wire is fixed in position on carrier 66 by, for example, stitched thread or an adhesive and covered by shell 68, which is typically another layer of material.

Frame 70 is generally made of a semi-rigid plastic that in one implementation is disposed about the perimeter of the electric heating element. Frame 70 maintains the shape of the electric heating element and generally prevents temperature control sources 60, 62 from bunching or folding when they are slidably inserted into control compartments 50, 52. Frame 70 also provides some rigidity to the control sources 60, 62 to facilitate sliding temperature control sources 60, 62 into control compartments 50, 52.

Power cord 74, shown in FIG. 1, connects temperature control sources 60, 62 to an external power source, such as a vehicle cigarette lighter or other electrical source. Power cord 74 may be routed through a cord channel between an exterior surface of portable food delivery container 10 and an interior surface of either control compartment. The cord channel can be a simple opening in access panel 48 or a tunnel running to any exterior surface of portable food delivery container 10. At the end of power cord 40 is quick-connect 76 that enables a user to quickly connect and disconnect power cord 74 to and from a power source. Electric link 72 electrically connects multiple temperature control sources in order to provide power through only one power cord. This simplifies wiring and reduces the number of cord channels in portable food delivery container 10. Generally, in assembly, a temperature control source will be installed into a control compartment, and power cord 74 may be fed through the cord channel until the power cord reaches the exterior of portable food delivery container 10.

Temperature control sources 60, 62 may be controlled by a thermostat. The thermostat could be located, for example, on an outer surface of shell 36 or within carrier 32. The thermostat senses the temperature of the temperature control source 20 and controls the time when conductor 30 is energized. This may facilitate maintaining the food storage compartment 20 within a predetermined or desired temperature range.

Control compartments 50, 52 may utilize various internal separators for housing multiple temperature control sources within a single control compartment. This may be desirable when the temperature control source is comprised of small individual units, such as ice packs, where each ice pack may be placed so that the internal separators limit the ice packs' movement within the control compartment. Other separators may also be useful for housing temperature control sources of various types, but maintaining proper separation.

Various other changes and modifications can be made in the construction of portable food delivery container 10 without departing from the spirit and scope of the invention. For example, control compartments 50, 52 could be located adjacent or within walls of the container other than or in addition to the upper and lower walls. In one example, a control compartment is formed inside food storage compartment 20, thereby creating a shelf, or separator that divides the food storage compartment 20 into two compartments. The two compartments may remain isolated from one another by forming the opening for the control compartment from an exterior surfaces of food storage compartment 20. By utilizing a control compartment as an internal shelf within food storage compartment 20, the distance between a temperature control source and the internal food items may be reduced. And the shelf may aid in internal weight distribution ensuring that the lowest food item will not be damaged by bearing too much weight. Control compartments 50, 52 as shown in FIGS. 3-5 may also be used in conjunction with shelf control compartments, or they may be omitted without departing from the spirit and scope of the present invention. Such changes and modifications are contemplated by the inventors and they do not wish to be limited except by the scope of the appended claims.

The invention claimed is:

1. A portable container, comprising:

a storage compartment having an outer surface and an opening through which an item can inserted into and removed from the storage compartment;

a closure that moves from an open position permitting access to the storage compartment via the opening to a closed position wherein the closure substantially covers the opening;

a control compartment lying adjacent to and in contact with the outer surface of the storage compartment, and having an opening spaced from the storage compartment opening and accessible when the closure is in its closed position; and a removable temperature control source disposed within the control compartment.

2. The container of claim 1 wherein the control compartment opening faces away from the storage compartment opening.

3. The container of claim 1 further comprising a plurality of control compartments, wherein each control compartment is located adjacent to an outer surface of the storage compartment.

4. The container of claim 1 wherein the removable temperature control source is an electric heating element having a semi-rigid frame.

5. The container of claim 4 wherein the removable temperature control source is controlled by a thermostat that is in thermal connection with the storage compartment.

6. The container of claim 2 further comprising an access panel that moves between open and closed positions, selectively permitting access to the control compartment.

7. The container of claim 1 wherein the storage compartment and the control compartment both have outer surfaces that are exposed to the environment and at least those outer surfaces exposed to the environment are insulated.

8. The container of claim 1 further comprising a cord channel for an electric cord running from an inside surface of the control compartment to an outside surface of the closure.

9. The container of claim 6 wherein the access panel selectively covers the control compartment opening and when the access panel is open, a temperature control source can be inserted into or removed from the control compartment through the opening.

10. The container of claim 9 wherein the opening to the control compartment is not communicated with the opening to the storage compartment.

11. The container of claim 2 wherein the control compartment is isolated from the storage compartment even when the control compartment is open.

12. A portable temperature-controlled food delivery container, comprising:

a plurality of walls having inner surfaces that define a food storage compartment and an opening through which a food item can be inserted into and removed from the food storage compartment, the walls also having outer surfaces generally opposed to the inner surfaces;

an entry flap that moves from an open position allowing a food item to be inserted through the opening to a closed position substantially covering the opening and closing the food storage compartment;

a control compartment defined between an outer surface of at least one of said walls that define the food storage compartment and an exterior wall that does not define the food storage compartment, the control compartment having an opening that is isolated from the food storage compartment and wherein the control compartment is communicated with the food storage compartment only through said at least one of said walls that define the food storage compartment; and a temperature control source disposed within the control compartment that effects thermal energy transfer between the control compartment and the food storage compartment, wherein the temperature control source is maintained entirely separate from the food storage compartment and is removable from the control compartment.

13. The portable temperature-controlled food delivery container of claim 12 wherein the opening of the control compartment lies adjacent to a rear wall of the food storage compartment and the temperature control source is inserted into the control compartment in a direction that is opposite to the direction in which a food item is inserted into the food storage compartment.

14. The portable temperature-controlled food delivery container of claim 12 wherein the control compartment forms a shelf inside the food storage compartment.

15. The portable temperature-controlled food delivery container of claim 12 further comprising a plurality of control compartments, wherein each control compartment is located adjacent to an outer surface of a wall that defines part of the food storage compartment.

16. The portable temperature-controlled food delivery container of claim 12 wherein the removable temperature control source is an electric heating element having a semi-rigid frame.

17. The portable temperature-controlled food delivery container of claim 12 further comprising an access panel that is movable between open and closed positions to selectively permit access to the control compartment.

18. The portable temperature-controlled food delivery container of claim 17 wherein the access panel selectively covers the opening to the control compartment and when the access panel is open, a temperature control source can be inserted into or removed from the control compartment.

19. The portable temperature-controlled food delivery container of claim 18 wherein the opening to the control compartment is not communicated with the opening to the food storage compartment.

20. The portable temperature-controlled food delivery container of claim 12 wherein the control compartment opening is isolated from and not open to the food storage compartment even when the control compartment opening is open to receive a temperature control source.

21. The container of claim 15 further comprising a single access panel that moves between open and closed positions to selectively permit access to each control compartment.

22. The container of claim 3 further comprising a single access panel that moves between open and closed positions to selectively permit access to each control compartment.

* * * * *